US008217786B2

(12) United States Patent
Ziegler

(10) Patent No.: US 8,217,786 B2
(45) Date of Patent: Jul. 10, 2012

(54) CHECKING APPARATUS FOR CONTAINERS

(75) Inventor: Manfred Ziegler, Ruderting (DE)

(73) Assignee: Krones AG (DE)

( * ) Notice: Subject to any disclaimer, the term of this patent is extended or adjusted under 35 U.S.C. 154(b) by 505 days.

(21) Appl. No.: 12/498,244

(22) Filed: Jul. 6, 2009

(65) Prior Publication Data

US 2010/0171613 A1 Jul. 8, 2010

(30) Foreign Application Priority Data

Jul. 4, 2008 (DE) ..... 10 2008 031 679

(51) Int. Cl.
*G08B 21/00* (2006.01)

(52) U.S. Cl. ..... 340/540; 340/568.1; 340/554; 340/676; 340/693.5

(58) Field of Classification Search ..... 340/539.1, 340/540, 568.1, 551, 552, 554, 673, 674, 340/675, 676, 693.5, 693.6
See application file for complete search history.

(56) References Cited

U.S. PATENT DOCUMENTS

| | | | | |
|---|---|---|---|---|
| 7,240,553 | B2 | 7/2007 | Segura et al. | 73/597 |
| 7,275,438 | B2 | 10/2007 | Focke et al. | 73/617 |
| 7,743,801 | B2 * | 6/2010 | Janardhanam et al. | 141/351 |
| 2006/0087325 | A1 | 4/2006 | Ariav et al. | 324/637 |
| 2007/0272019 | A1 * | 11/2007 | Agam et al. | 73/628 |
| 2008/0156395 | A1 * | 7/2008 | Janardhanam et al. | 141/351 |
| 2009/0050826 | A1 | 2/2009 | Schoen | 250/559.4 |

FOREIGN PATENT DOCUMENTS

| | | |
|---|---|---|
| DE | 1 256 094 | 12/1967 |
| DE | 26 34 637 | 2/1978 |
| DE | 43 22 849 | 12/1994 |
| DE | 199 21 217 | 11/2000 |
| DE | 201 10 686 | 9/2002 |
| DE | 203 12 388 | 12/2003 |
| DE | 10 2004 056 742 | 9/2005 |
| DE | 10 2006 049 981 | 4/2008 |
| EP | 1 514 943 | 3/2005 |
| WO | WO 2004/033305 | 4/2004 |

* cited by examiner

*Primary Examiner* — Travis Hunnings
(74) *Attorney, Agent, or Firm* — Hayes Soloway P.C.

(57) ABSTRACT

An apparatus for checking for the presence of objects and in particular containers, comprising a transmitting device which has a sound signal generation unit for emitting a sound signal, and a receiving device which is arranged relative to the transmitting device in such a way that a sound signal emitted by the transmitting device and transmitted through air can be received by the receiving device. According to the invention, at least the transmitting device or the receiving device has a housing, wherein at least one region of this housing is suitable for emitting or for receiving sound signals.

18 Claims, 2 Drawing Sheets

CHECKING APPARATUS FOR CONTAINERS

BACKGROUND OF THE INVENTION

The present invention relates to an apparatus for checking for the presence of objects and in particular containers. In the beverage-producing industry, it is customary for beverage containers to be produced, filled, labelled and further treated in a multiple-unit process. In this case, the containers are transported for example by means of rotary starwheels from one treatment unit to a further treatment unit. It is often necessary to check whether a container is in actual fact arranged in a certain position, for example whether a certain gripping clamp is occupied by a container. If a gripping clamp for example is not occupied by a container, this may lead to the situation whereby a beverage is filled into a container that does not exist and therefore soiling of the installation occurs.

It is known in the prior art to use ultrasound elements to check whether certain gripping clamps are occupied by containers. For this purpose, there is usually provided an ultrasound transmitter and also an ultrasound receiver, and the gripping clamps holding the containers to be treated are transported between these two units.

If a container is present in a certain position, the signal transmission from the ultrasound transmitter to the ultrasound receiver is interrupted and in this way the state of occupancy of the corresponding gripping element can be checked.

The sensors known to date as the prior art are usually made from plastics, such as Teflon for example. The ultrasound transmitter has a loudspeaker on its outer region, and the receiver accordingly has a microphone which picks up the sound signal from the transmitter. Particularly in applications in the so-called clean-room sector, in some cases considerable external treatments with further liquid and gaseous media take place. This often leads to failures of the transmitting and receiving units and requires inter alia an intervention in the sterile area in order to dry the sensors.

The object of the present invention is therefore to provide an apparatus for checking for the presence of objects, in particular containers, which particularly in critical environments, such as clean-room areas for example, is less susceptible to substances such as cleaning gases for example.

SUMMARY OF THE INVENTION

An apparatus according to the invention for checking for the presence of objects and in particular containers comprises a transmitting device which has a sound signal generation unit for emitting a sound signal, and a receiving device which is arranged relative to the transmitting device in such a way that a sound signal emitted by the transmitting device and transmitted through air can be received by the receiving device. According to the invention, at least the transmitting device or the receiving device has a housing, wherein at least one region of the housing is suitable for emitting or for receiving sound signals.

While in the prior art—as mentioned above—loudspeakers and microphones are provided on the outer wall of the relevant plastic housings, it is proposed according to the invention not to provide these elements but instead to allow the housing itself to act as a loudspeaker or as a microphone. In this way, it is possible to omit the very sensitive elements such as loudspeakers and microphones on the outer wall of the housing. It has surprisingly been found that, given an appropriate design of the housing, it is possible for a housing wall itself to act as a loudspeaker. It is likewise possible that, given appropriate power levels of the sound signals, a housing or part of the housing can also act as a receiver. In this case, it would be possible either to arrange a loudspeaker in the interior of this housing, which causes the housing to vibrate, or to provide in the interior of the housing for example a coil which is coupled to part of the housing wall and in this way generates vibrations of the housing wall.

In this case, however, preferably much higher power levels are used than in the case of customary transmitting and receiving units from the prior art.

In one preferred embodiment, both the transmitting device and the receiving device have a respective housing, and the housing of the transmitting device is suitable for emitting a sound signal and the housing of the receiving device is suitable for receiving a sound signal. The sound signal is preferably an ultrasound signal.

In this embodiment, both the loudspeaker unit and the microphone unit, which in the prior art are provided on the outer region of the housing, are replaced.

In a further advantageous embodiment, at least one housing is completely closed. In this way, the inner region of this housing, which also contains for example the control devices and the like, can be protected in a particularly advantageous manner. In one preferred embodiment, the housing comprises a main body and a head which is welded onto this main body, so that after the welding process the housing is closed in an essentially irreversible manner.

In a further advantageous embodiment, arranged in the interior of the housing of the transmitting device is a converter device which converts electrical vibrations in particular into mechanical vibrations and thus generates for example an ultrasound signal. This converter device may be on the one hand a loudspeaker which is arranged in the interior of the housing. However, other sound-generating devices would also be conceivable. As mentioned above, a coil could also be coupled directly to the housing or to a section such as, for example, an end wall of the housing.

In a corresponding manner, there is also arranged in the interior of the receiving device a further converter device which converts mechanical or acoustic vibrations back into electrical vibrations. In this case, this converter device may be for example in mechanical contact with a region of the housing such as a wall of the housing, and may operate in a manner similar to a microphone.

In a further advantageous embodiment, the housing of the transmitting device has a first wall section with a first predefined wall thickness and a second wall section with a second predefined wall thickness, wherein the second wall thickness is smaller than the first wall thickness. Preferably, a main body of the housing is produced with a thicker wall thickness and a head end or front end of the housing is produced with a thinner wall thickness. This thinner wall thickness can be caused to vibrate, and in this way for example a front face of the housing can act in a manner similar to the membrane of a loudspeaker. Preferably, as mentioned above, these two wall sections are welded to one another. A second wall section is thus preferably a cover of the relevant housing.

In a corresponding manner, the housing of the receiving device also has a first wall section with a first predefined wall thickness and a second wall section with a second predefined wall thickness, wherein the second wall thickness is smaller than the first wall thickness. In this way, the second wall thickness can also serve to pick up acoustic signals and thus can be caused to vibrate mechanically.

In a further advantageous embodiment, at least one housing and preferably both housings is/are made from stainless steel. In general, both the transmitting device and the receiving device are preferably of all-steel construction, and with particular preference are of hygienic design for the detection of individual containers.

In a further advantageous embodiment, the transmitting device is arranged on a holder and the transmitting device has a vibrating region for emitting the sound signal, wherein the holder is arranged on the transmitting device in a region thereof which is arranged at a distance from the vibrating region. By means of this holder, the transmitting device can be brought into a specific position. As mentioned above, preferably just one region of the transmitting device can be caused to vibrate. By contrast, the holder is arranged in another region so that the vibrations produced are not damped by the holder. The holder is preferably arranged in a region of the transmitting device which is not the vibrating region itself but adjoins the latter. In this way, a particularly stable mounting of the transmitting device can be provided.

In a further advantageous embodiment, the receiving device is also arranged on a holder and the receiving device has a vibrating region for receiving the sound signal, wherein the holder is arranged on the receiving device in a region thereof which is arranged at a distance from the vibrating region. In a corresponding manner, the holder is again placed not on the vibrating region itself, so as once again to prevent any damping by the holder.

In a further advantageous embodiment, at least one housing and preferably both housings has/have a smooth outer contour. Such smooth contours are easy to clean and also liquids can easily slide off these smooth surfaces. The housings preferably have in each case a cylindrical cross-section and particularly preferably end faces with rounded edges.

The respective second wall section of the two housings is preferably a cover or a front face of this housing. This front face is particularly suitable for emitting sound signals and also for receiving the latter.

In a further advantageous embodiment, the transmitting device and the receiving device are arranged on a common carrier. In this case, this carrier is preferably configured in such a way that mechanical vibrations generated by the transmitting device are not mechanically transmitted via the carrier to the receiving device. Account should be taken here of the fact that the transmitting device according to the invention has to emit with much higher power levels since—as mentioned—one region of the housing is caused to vibrate. This may lead to the situation whereby the entire carrier, or the region on which the transmitting device is arranged, is likewise caused to vibrate and these vibrations are transmitted directly to the receiving device. In this case, the receiving device would register receipt of a signal, even if a bottle is arranged between the transmitting device and the receiving device, since this signal would be transmitted via the carrier. The carrier therefore preferably has damping units which prevent any direct transmission of mechanical vibrations to the receiving device.

The present invention also relates to an installation for treating containers, comprising a transport device which transports the containers along a predefined transport path and also at least one apparatus of the type described above. This installation for treating containers may be in particular, but not exclusively, an installation for filling containers, for labelling containers, for transporting containers, for blow-moulding containers and combinations thereof and the like.

Further advantageous embodiments will emerge from the appended drawings:

DETAILED DESCRIPTION OF THE INVENTION

Figure 1A:
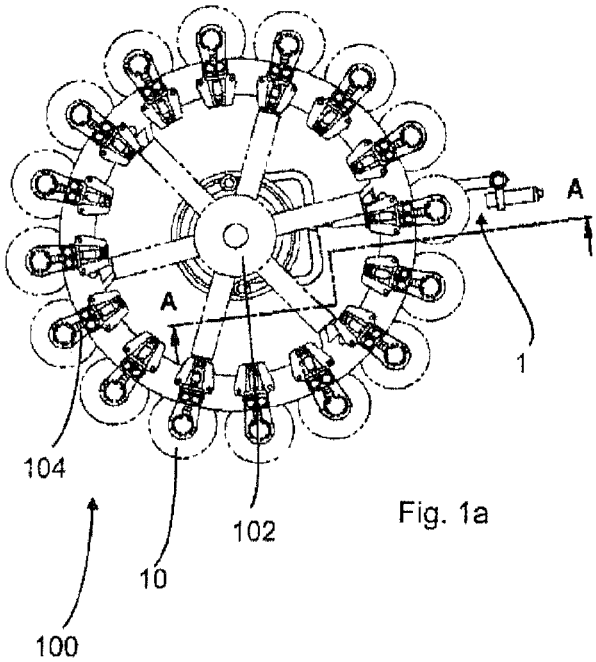
FIG. 1*a* shows a plan view of an installation according to the invention.

FIG. 1*a* shows a plan view of an installation 100 according to the invention. This installation 100 comprises a transport device 102, in this case a transport starwheel, on the outer circumference of which there is arranged a plurality of gripping elements 104 which are in each case able to grip containers 10 at the mouths thereof. This transport device 102 rotates in a preferred direction, here for example in the anti-clockwise direction. This installation comprises an apparatus 1 according to the invention which detects whether containers 10 are in each case arranged on the gripping elements.

Figure 1B:
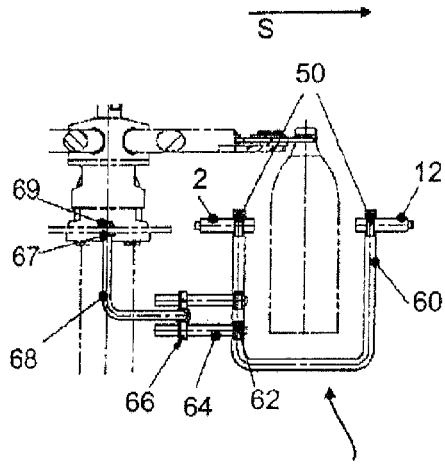
FIG. 1*b* shows a partial view along the line A-A in FIG. 1*a;*

FIG. 1*b* shows a partial view from FIG. 1*a* along the line A-A in FIG. 1*a*. More specifically, FIG. 1*b* shows a plan view of the apparatus 1 according to the invention. This apparatus comprises a transmitting device 2 which emits a sound signal and in particular an ultrasound signal. A receiving device 12 can receive this ultrasound signal, which moves in particular in the direction S. If, however, a container 10 is located between the transmitting device 2 and the receiving device 12, no signal is received by the receiving device 12. For the sake of simplification, the transmitting device 2 and the receiving device 12 are arranged on a common carrier 60. This carrier 60 is in turn arranged on a holding rod 68 via holders 62, transverse rods 64 and further holders 66. This holding rod 68 is arranged in a fixed, i.e. stationary, manner in the region of the transport device 102 or a sleeve 108 of the rotation shaft of the transport device 102. This construction with a plurality of holding devices and rods 62, 64, 66, 68 brings about a damping of the holder 60, particularly at those frequencies at which the ultrasound signal of the transmitting device 2 is emitted.

Figure 2:
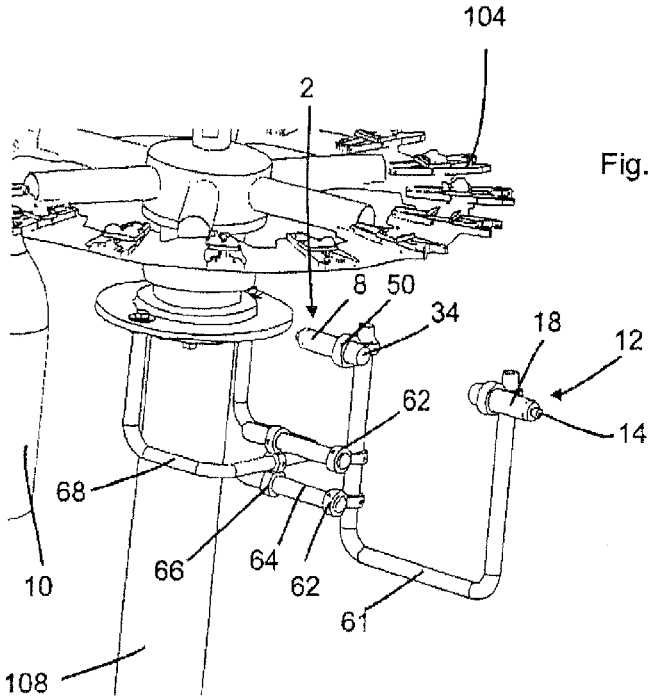
FIG. 2 shows a perspective partial view of the installation of FIG. 1*a;*

FIG. 2 shows a perspective detail view of the arrangement shown in FIG. 1*a*. Here too, the transmitting device 2 and receiving device 12 are again shown, wherein these two devices are configured in an extremely similar manner and have a respective housing 8, 18. These housings 8, 18 in each case have front faces, although only the front face 34 of the transmitting device 2 is shown. The front faces 34 have—as mentioned above, a smaller wall thickness than the other regions of the housing 8. At the same time, this front face or the cover 34 can be caused to vibrate and in this way can emit the sound signals. Reference 50 denotes a holding device for arranging the transmitting device 2 on the carrier 60.

Reference 61 denotes a transverse connection of the holding device 60 for spacing the transmitting device 2 apart from the receiving device 12. On the whole, as mentioned above, the carrier 60 is designed in such a way that it cannot itself be caused to vibrate, particularly in the frequency range of the emitted sound vibrations.

Figure 3:
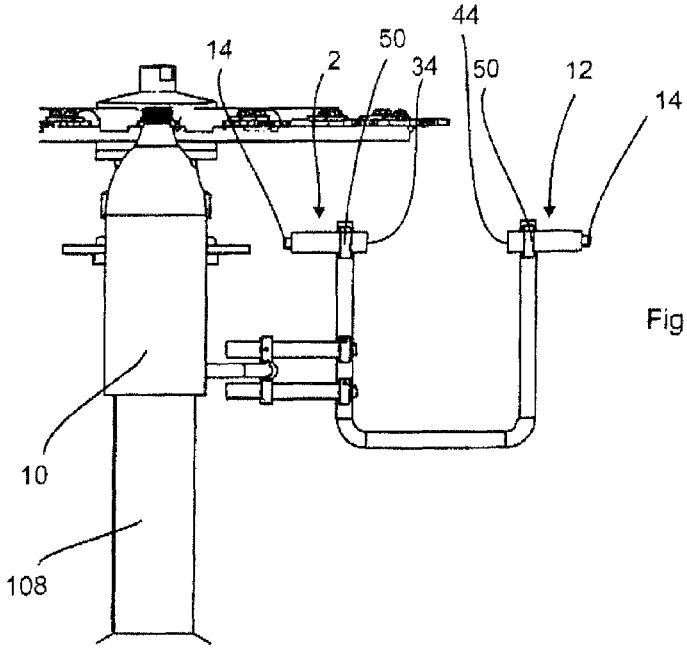
FIG. 3 shows a partial plan view of the apparatus of FIG. 1*a;*

FIG. 3 shows a side view of the apparatus shown in FIG. 2. It can be seen here that the respective front faces 34 and 44 of the transmitting device 2 and of the receiving device are located directly opposite one another and at the same height, so that the sound signal can be transmitted in a particularly advantageous manner unless a container 10 is located in the intermediate region between the transmitting device 2 and the receiving device 12. In this case, it is possible that the transmitting device 2 emits its signal in a controlled manner, that is to say that the emission of this ultrasound signal is adapted to a rotation of the transport device 102 and a signal is emitted only when a container is to be expected between the transmitting device and the receiving device 12. However, it would also be possible for the ultrasound signal to be emitted continuously.

Figure 4:
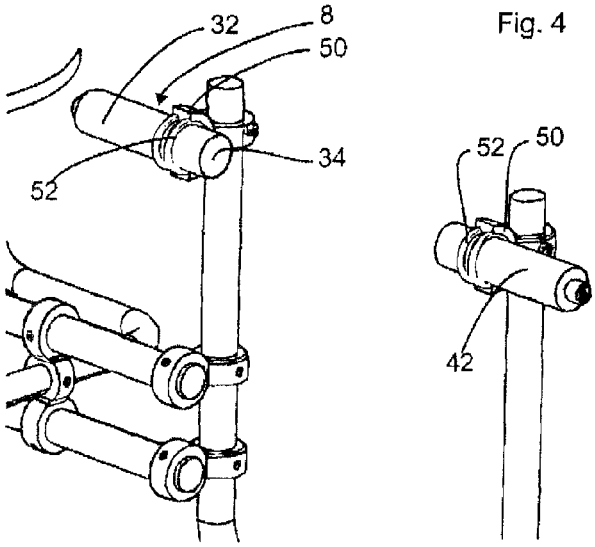
FIG. 4 shows a perspective detail view of an apparatus according to the invention.

FIG. 4 shows an enlarged diagram of the view shown in FIG. 3. It is possible to see here the two holders 50, by means of which the transmitting device 2 and the receiving device 12 are arranged on the carrier 60. This holder 50 preferably has a flexible ring 52 which together with the holder 50 surrounds the housing 8 of the transmitting device. By means of this flexible ring 52, it is possible for vibrations of the housing to be damped. A corresponding arrangement is also located on the receiving device 12.

Figure 5:
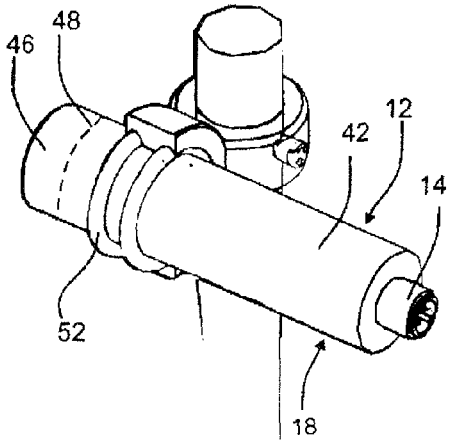
FIG. 5 shows a transmitting device or receiving device according to the invention with a holder.

FIG. 5 shows an enlarged view of the receiving device 12. It can be seen here that the housing has a first wall section 42 which at the same time forms the main body of the housing 18. The second section 44 with the thinner wall is arranged on this first wall section 42 by means of a welded join 48. Most of the electronics of the transmitting device are located in the interior of the main body 42. A converter device (not shown) may be coupled to the second section and in particular to the front face 44, in order to pick up vibrations.

Reference 14 denotes an electrical connection for actuating the receiving device 12. A corresponding connection is also provided on the transmitting device 2.

The invention claimed is:

1. An apparatus for checking for the presence of objects, comprising a transmitting device which has a sound signal generation unit for emitting a sound signal, and a receiving device which is arranged relative to the transmitting device in such a way that a sound signal emitted by the transmitting device and transmitted through air can be received by the receiving device, wherein at least the transmitting device or the receiving device includes a housing, wherein at least one region of said housing is suitable for emitting or for receiving sound signals so that the housing itself acts as a loudspeaker or as a microphone.

2. The apparatus according to claim 1, wherein both the transmitting device and the receiving device have a respective housing, and the housing of the transmitting device is suitable for emitting a sound signal and the housing of the receiving device is suitable for receiving the sound signal.

3. The apparatus according to claim 1, wherein the at least one housing is completely closed.

4. The apparatus according to claim 1, wherein arranged in the interior of the housing of the transmitting device is a converter device which converts electrical vibrations into mechanical vibrations.

5. The apparatus according to claim 1, wherein the housing of the transmitting device has a first wall section with a first predefined wall thickness and a second wall section with a second predefined wall thickness, wherein the second wall thickness is smaller than the first wall thickness.

6. The apparatus according to claim 1, wherein the housing of the receiving device has a first wall section with a first predefined wall thickness and a second wall section with a second predefined wall thickness, wherein the second wall thickness is smaller than the first wall thickness.

7. The apparatus according to claim 5, wherein at least a second wall section is a cover of the housing.

8. The apparatus according to claim 1, wherein at least one housing is made from stainless steel.

9. The apparatus according to claim 1, wherein the transmitting device is arranged on a holder and the transmitting device has a vibrating region for emitting the sound signal, wherein the holder is arranged on the transmitting device in a region thereof which is arranged at a distance from the vibrating region.

10. The apparatus according to claim 1, wherein the receiving device is arranged on a holder and the receiving device has a vibrating region for receiving the sound signal, wherein the holder is arranged on the receiving device in a region thereof which is arranged at a distance from the vibrating region.

11. The apparatus according to claim 1, wherein at least one housing has at least partially a smooth outer contour.

12. The apparatus according to claim 1, wherein the transmitting device and the receiving device are arranged on a common carrier.

13. The apparatus according to claim 12, wherein the carrier is configured in such a way that mechanical vibrations generated by the transmitting device are not mechanically transmitted via the carrier to the receiving device.

14. An installation for treating containers, comprising a transport device which transports the containers along a predefined transport path and also at least one apparatus according to claim 1.

15. The apparatus according to claim 6, wherein at least a second wall section is a cover of the housing.

16. The apparatus according to claim 12, wherein the transmitting device and the receiving device are mounted to the camera by a damping mounting.

17. The apparatus according to claim 16, wherein the damping mounting comprises a flexible ring.

18. The apparatus according to claim 1, wherein the objects comprise containers.

* * * * *